United States Patent [19]

Ogawa et al.

[11] Patent Number: 4,886,004

[45] Date of Patent: Dec. 12, 1989

[54] NEEDLE THREAD TENSION CONTROL INCLUDING SEPARATE STOPPING AND ADJUSTABLE PRE-TENSION DEVICES

[75] Inventors: Masao Ogawa, Nagoya; Toshio Sasaki, Inazawa, both of Japan

[73] Assignee: Brother Kogyo Kabushiki Kaisha, Aichi, Japan

[21] Appl. No.: 194,317

[22] Filed: May 16, 1988

[30] Foreign Application Priority Data

May 15, 1987 [JP] Japan ..... 62-119464
May 15, 1987 [JP] Japan ..... 62-119465

[51] Int. Cl.[4] ..... D05B 47/04

[52] U.S. Cl. ..... 112/254; 112/229; 112/250; 112/255; 112/302

[58] Field of Search ..... 112/254, 250, 253, 241, 112/255, 229, 302; 242/150 R

[56] References Cited

U.S. PATENT DOCUMENTS 2,955,775 10/1960 Johnson ..... 112/254 X
2,993,456 7/1961 Herbst ..... 112/254
4,235,178 11/1980 Ackermann ..... 112/229
4,429,649 2/1984 Eguchi et al. ..... 112/254
4,632,048 12/1986 Matsubara .
4,694,765 9/1987 Diehl ..... 112/254
4,776,293 10/1988 Yoshida ..... 112/302
4,791,876 12/1988 Sasaki et al. ..... 112/255 X
4,793,273 12/1988 Hara et al. ..... 112/254

FOREIGN PATENT DOCUMENTS 2924709 1/1981 Fed. Rep. of Germany ..... 112/254
53-41580 11/1978 Japan .
60-19278 5/1985 Japan .

*Primary Examiner*—Andrew M. Falik
*Attorney, Agent, or Firm*—Barnes & Thornburg

[57] ABSTRACT

In a sewing machine provided with a thread supply stopping device for selectively controlling supply of a needle thread between a needle thread supply source and a take-up lever, an adjustable pre-tension exerting device exerts a tension equal to or lower than a tension of a bobbin thread on the needle thread between the needle thread supply source and the thread stopping device.

5 Claims, 6 Drawing Sheets

NEEDLE THREAD TENSION CONTROL INCLUDING SEPARATE STOPPING AND ADJUSTABLE PRE-TENSION DEVICES

BACKGROUND OF THE INVENTION

The present invention relates to a needle thread tension control device for a sewing machine, and particularly to a device comprising a thread supply stopping means for stopping supply of a needle thread at a predetermined timing and a tension adjusting means for imparting the needle thread drawn out from a thread supply source a weaker tensile force equal to or lower than that of a bobbin thread.

In a conventional tension control device, there was provided a thread adjusting disc on a needle thread supply path from a thread supply spool to a thread guide of a take-up lever in order to adjust the tension of the needle thread by regulating the resilient force of a spring mounted on the thread adjusting disc to comply with the thickness of a work fabric to be sewn, the thickness of the thread used, the length of a seam, stitch work, etc.

However, in the conventional tension adjusting device, the spring of the thread adjusting disc is required to exert a somewhat stronger force on the needle thread in order to prevent it from being supplied in excess of the required amount for a subsequent stitching when the take-up lever is driven upward. And the spring is adjusted to exert a tension of ten times as much as a tension of the bobbin thread on the needle thread. Accordingly, the needle thread always remains under a strong clamping pressure, and therefore if the sewing machine is put in motion without loading of the fabric to be sewn at the beginning and ending of a sewing operation (this will be referred to as "idling"), the needle thread can not be fed readily by a feed dog and the needle thread tends to go in the reverse direction during upward motion of the take-up lever, thereby causing an excessive supply of the needle thread, which may cause the needle thread to wrap round a looptaker with the result that the sewing machine will become inoperative.

Japanese Patent Publication No. 53-41580 disclosed a thread control mechanism for use in a sewing machine for electrically controlling a tension adjusting disc, wherein the tension adjusting disc actuated by a solenoid is driven not to give any tension to the needle thread with its solenoid deenergized when the needle thread is supplied from a thread supply spool to form a seam, and in a subsequent period of time can serve to clamp the needle thread with the energized solenoid. Thus, even in the event of idling, the needle thread may be fed by the feed dog so smoothly that the needle thread will not twine around the looptaker.

Japanese Patent Publication No. 60-19278 discloses a thread tightening control device for automatically adjusting supply of a needle thread, in which there is provided between a thread supply spool and a take-up lever a needle thread tension device for providing the needle thread with a tension higher than that to be exerted on a bobbin thread, and between the take-up lever and a needle an electromagnetic thread restraining unit for clamping and releasing the needle thread is provided. When thread tightening is carried out by the elevation of the take-up lever to form an intersection between the needle thread and bobbin thread in the center of thickness of a fabric to be sewn, the electromagnetic thread restraining unit is energized to stop tightening of the needle thread, and then in association of the upward movement of the take-up lever, a predetermined amount of the needle thread is discharged through the thread tension device from the thread supply spool.

The U.S. Pat. No. 4,632,048 discloses an upper thread controlling device provided with a thread tension device and a electrical clamping magnet on the thread supply path extending from the thread supply source to the needle. For the first period of time during which the tension in the upper thread is varied due to changes in the rotational speed of the spindle of the sewing machine, a restraining force is applied to the upper thread by the electrical clamping magnet. For the second period of time during which the upper thread is released from the loop controlling tail and stitch tightening is completed, a tension required for stitch tightening is applied to the upper thread by the lower clamping force of the thread tension device.

The thread control mechanism disclosed in the Patent Publication No. 53-41580 has a problem, however, in that since the needle thread is released with no tension exerted thereon when it is supplied from the thread supply spool in association with the feed motion of the fabric, the thread supply spool and the needle thread are subjected to an inertia force, thereby to supplying more needle thread than required with reference to the amount of the feed stroke. Furthermore, it is always difficult to make a fine adjustment of the tension of the needle thread by use of the thread control mechanism. Another problem is that it is impossible to carry out a tacking stitching which requires a weaker thread tension or a gathering stitching which requires a stronger thread tension.

The upper thread controlling device disclosed in the U.S. Pat. No. 4,632,048 has the following problems. In a period of time from a moment after an upper thread is released from the loop controlling tail to a moment after stitch tightening is completed, despite that tightening of the upper thread is not completed, the electromagnet is released, and therefore during tightening of the upper thread, an extra amount of the upper thread may be drawn out from the upper thread supply source and thus a stable thread condition in stitches can not be achieved. Further, the tension exerted on the upper thread during tightening is adjusted to be a much stronger tension in comparison with the tension of the bobbin thread.

U.S. Patent Application Ser. No. 07/189,139 discloses a needle thread tension control system comprising a pre-tension device for exerting a tension on the needle thread and a thread supply control device which checks and releases the needle thread at respective suitable moments.

In this needle thread tension control system, by means of checking or releasing the needle thread at respective suitable moments according to the thickness of the needle thread, the tension of the needle thread can be controlled automatically.

Therefore, in this tension control system, the pre-tension device can be omitted, and also the pre-tension device is intended to be adjusted into an inoperative condition (i.e. zero pre-tension) for the stitching of ordinary seams.

But, the pre-tension device is installed for stitching of particular seams with intersections of the needle thread and the bobbin thread on the upper surface of the work fabric. That is, by exerting rather high pre-tension on the needle thread, intersections are formed on the upper surface.

However, in stitching ordinary seams, in the case where the pre-tension device is adjusted in the inoperative condition, above-mentioned problems are caused.

SUMMARY OF THE INVENTION

The object of the present invention is to provide a needle thread tension control device capable of exactly supplying a needle thread of an amount necessary for forming seams from the thread supply source and of delicately adjusting the tension of the needle thread.

The foregoing object is attained according to the principle of the present invention. The present invention relates to a needle thread tension control device for use in a sewing machine having an endwise reciprocatory needle with an eye; a needle thread supply source; a feed member for imparting a feed motion to a work fabric in timed relation with the reciprocation of the needle; thread supply stopping means for checking supply of a needle thread supplied from the needle thread supply source in a predetermined timing in synchronism with the feed motion of the feed member; and a needle thread supply path extending from the needle thread supply source via the thread supply stopping means to the eye of the needle. The needle thread tension control device of the first aspect of the present invention comprises tension adjusting means for exerting a tension on the needle thread between the thread supply source and the thread supply stopping means and for adjusting the tension to be a desired value equal to or lower than a tension of a bobbin thread.

With respect to the second aspect of the present invention, the sewing machine further comprises bobbin thread tension exerting means, and the needle thread tension control device comprises needle thread tension exerting means provided on the needle thread supply path between the needle thread supply source and the thread supply stopping means, for exerting a tension lower than the bobbin thread tension on the needle thread.

As described above, since a tension equal to or lower than that of the bobbin thread is applied to the needle thread at all times, it is possible to supply from the thread supply source an exact amount of the needle thread necessary for forming seams at the time when the needle thread is released by the thread supply stopping means. Consequently, only the necessary amount of the needle thread can be supplied without any hindrance by the tension adjusting means, thereby facilitating a stable and suitable thread tightening condition. Additionally, as the tension exerted on the needle thread is adjustable to a fine degree, a desired thread tightening tension is obtainable.

DESCRIPTION OF THE PREFERRED EMBODIMENTS

Preferred embodiments of the present invention will be described hereinafter with reference to the accompanying drawings.

Figure 1:
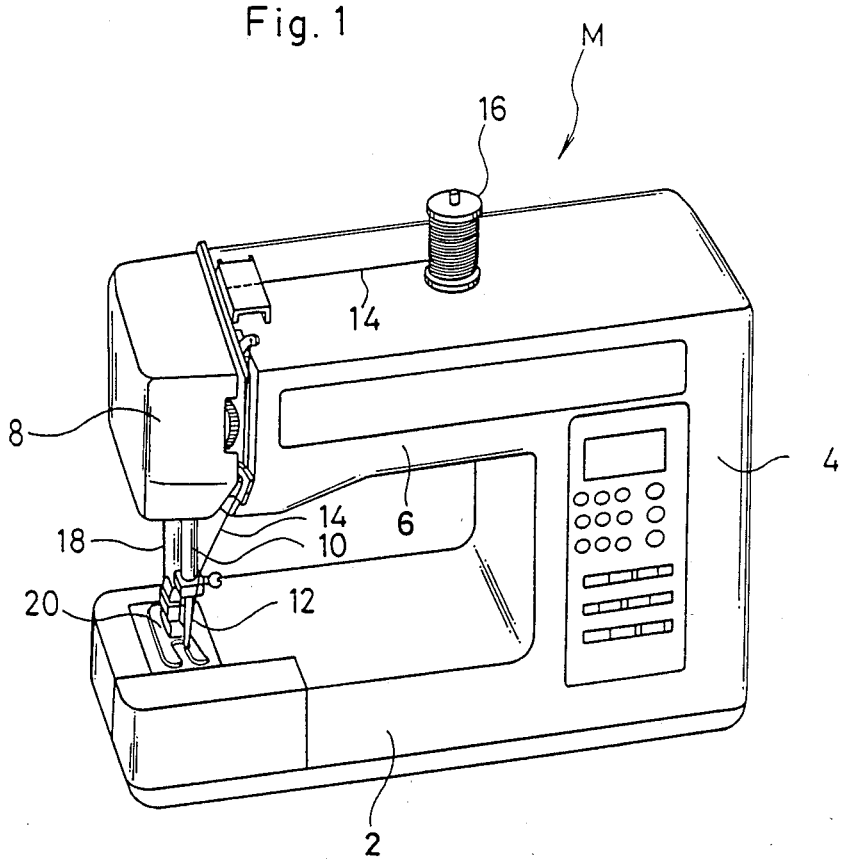
FIG. 1 is a schematic perspective view of a sewing machine incorporated an embodiment of the present invention.

FIG. 1 illustrates an electronic lock stitch sewing machine M incorporating an embodiment of the present invention. Illustrated in FIG. 1 are a bed 2, a standard 4 extending upright from the right end of the bed 2, and an arm 6 horizontally extending from the upper end of the standard 4, overhanging the bed 2 and having a head 8 at the left end thereof. A thread supply spool 16 (a needle thread supply source) is provided on the arm 6. A needle bar 10 and a presser bar 18 are provided in the head 8. A needle 12 is attached to the lower end of the needle bar 10. The needle bar 10 is driven for vertical reciprocatory motion and for lateral jogging motion by the arm shaft 28 of the sewing machine. A presser foot 20 is attached to the lower end of the presser bar 18. The presser bar 18 is raised or lowered by means of an operating member (not shown).

A throat plate 22 is provided on the bed 2, and a feed dog 23 is provided in the bed 2 so as to be moved upward through slots formed in the throat plate 22 by a feed mechanism. Predetermined stitches are formed in a work fabric through the cooperative operation of the needle bar 10 and the feed mechanism including the feed dog 23 (feed member). Since the feed mechanism is of an ordinary known construction, the description thereof will be omitted.

Figure 2:
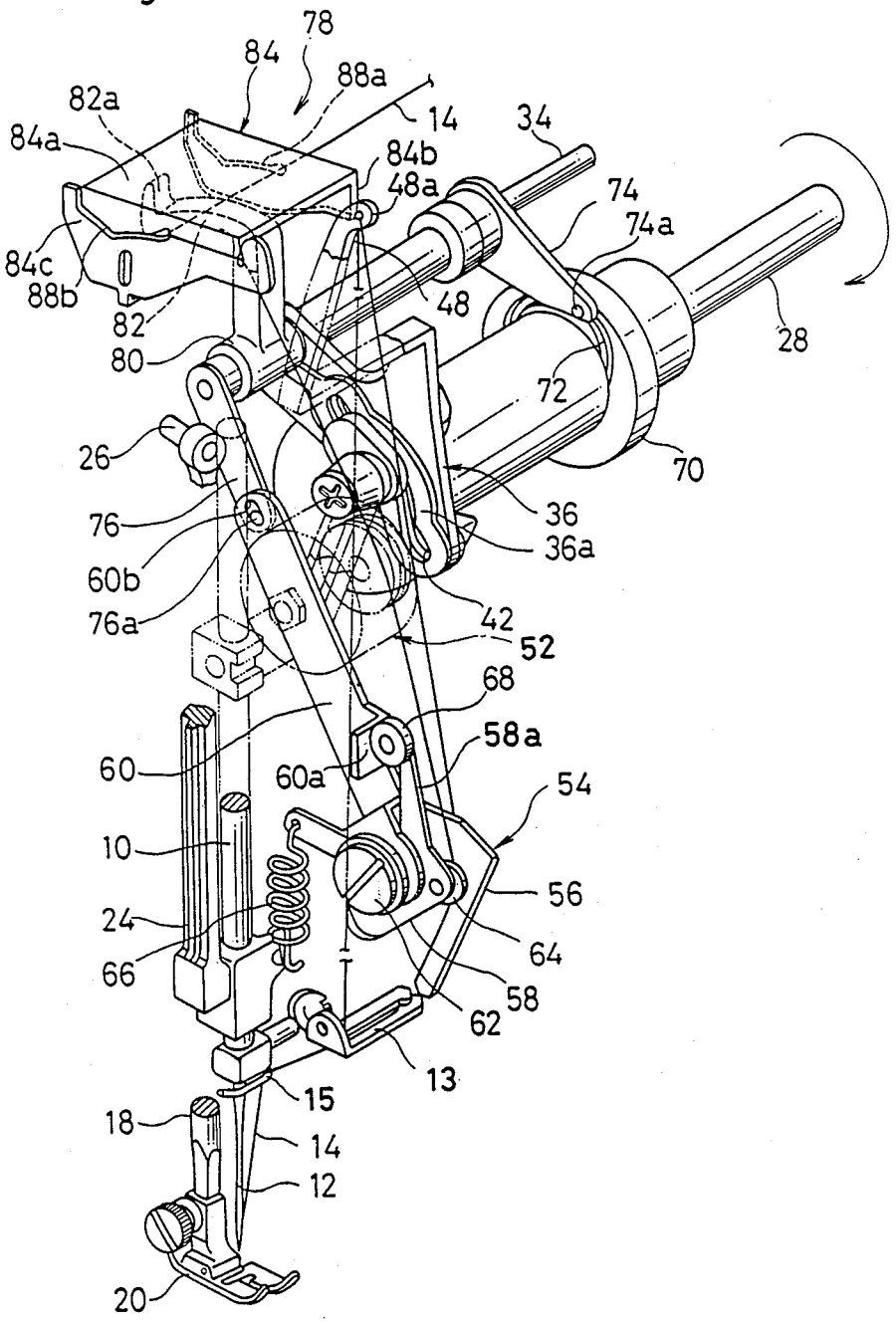
FIG. 2 is a perspective view of the essential portion of the internal mechanism built in the head of the sewing machine of FIG. 1.
Figure 3:
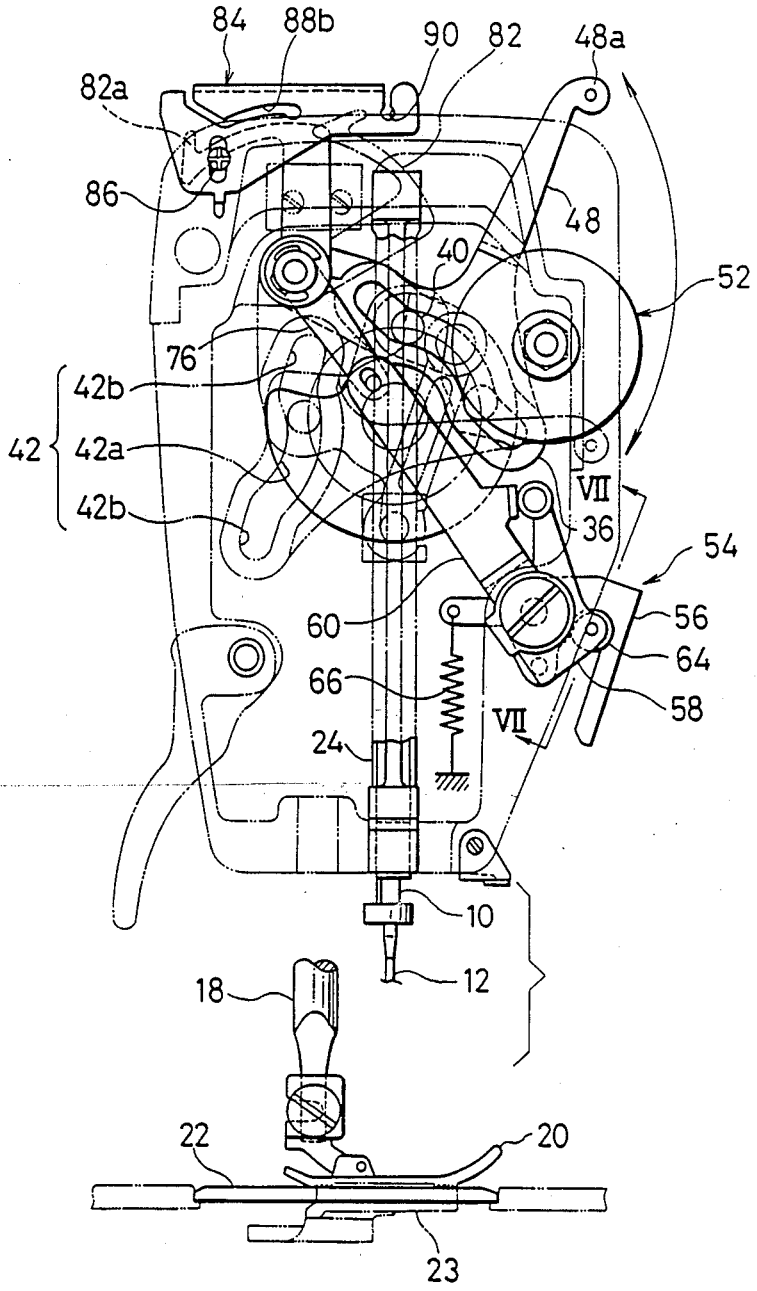
FIG. 3 is a side elevation of the internal mechanism of FIG. 2.
Figure 4:
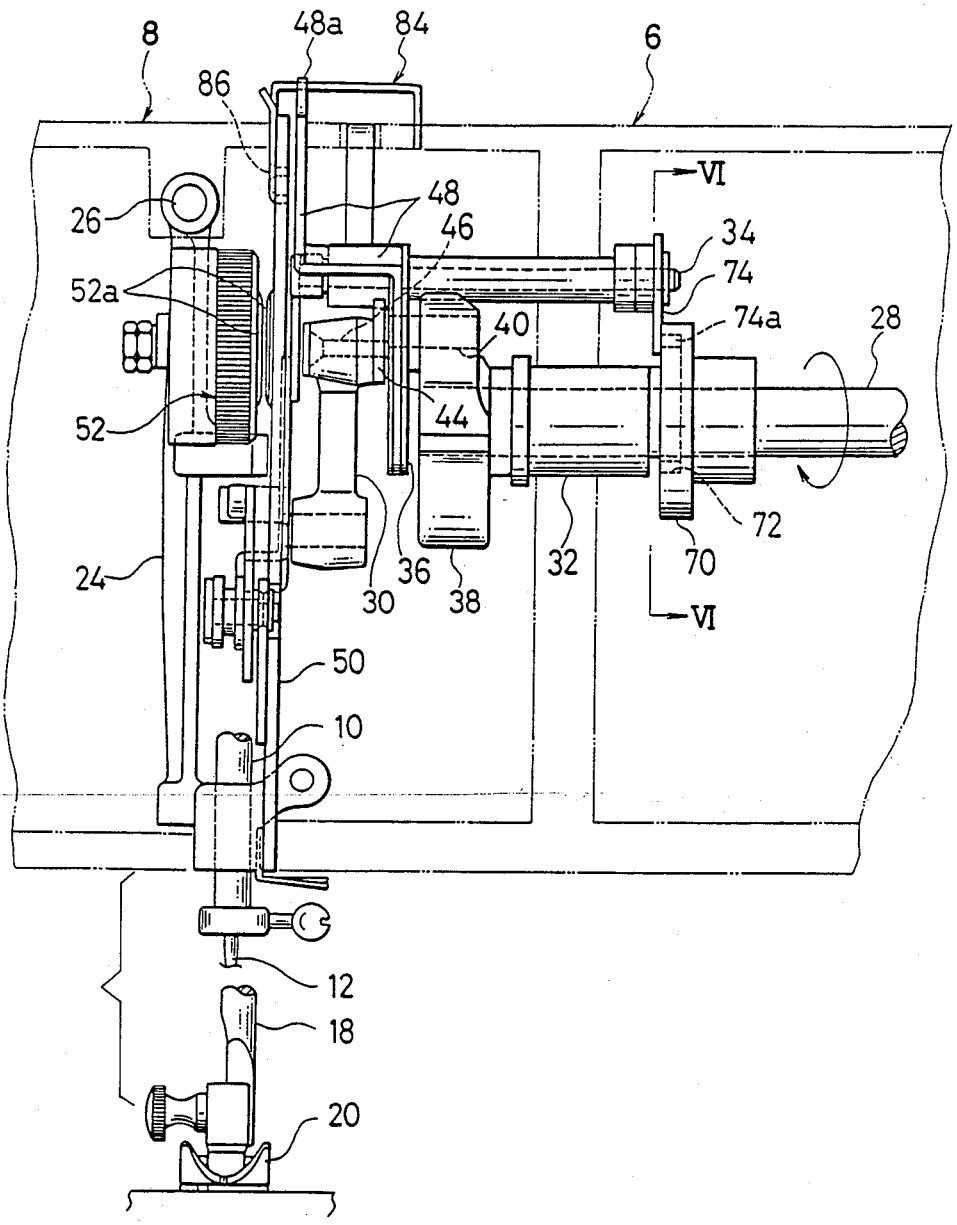
FIG. 4 is a front elevation of the internal mechanism of FIG. 2.

FIGS. 2 to 4 illustrate internal mechanisms disposed within the head 8 and part of the arm 6 near the head 8 of the sewing machine M.

As illustrated in FIGS. 2 to 4, the needle 12 is attached to the lower end of the needle bar 10, while the needle bar 10 is supported vertically movably by a needle bar support 24. The needle bar support 24 is supported pivotally at the upper end thereof with a pin 26 on the frame so as to jog laterally. The needle bar 10 is driven by the arm shaft 28 and a needle bar crank 30 secured to the free end of the arm shaft 28 for vertical motion relative to the needle bar support 24.

The presser foot 20 is attached detachably to the lower end of the presser bar 18, while the presser bar 18 is secured to the frame by a mechanism (not shown) so as to be moved between an upper position and a lower position. When the presser bar 18 is moved to the lower position, the presser foot 20 presses a work fabric against the throat plate 22.

A take-up lever mechanism will be described hereinafter with reference to FIGS. 2 to 4.

The arm shaft 28 is supported rotatably in a bearing bush 32 on the frame. An auxiliary shaft 34 is disposed above and behind the arm shaft 28 so as to extend in parallel to the same. The auxiliary shaft 34 is journalled on the frame. A swing lever 36 is supported swingably at one end thereof on the auxiliary shaft 34. The swing lever 36 extends from the auxiliary shaft 34 to the left side of a take-up lever crank 38 fixedly mounted on the arm shaft 28. The crank pin 40 of the take-up lever crank 38 extends through a cam slot 42 formed in the swing lever 36. A connecting plate 44 is fixed to the left end of the crank pin 40. The needle bar crank 30 is connected rotatably to the connecting plate 44 with a pin 46 extending leftward from the connecting plate 44. The needle bar crank 30 is connected at the lower end thereof to the middle part of the needle bar 10.

The upper part of the swing lever 36 is bent in a zigzag shape to form a take-up lever 48 (take-up member) which extends upward. A thread guide hole 48*a* is formed at the free end of the take-up lever 48.

As illustrated in FIGS. 2 and 3, the cam slot 42 of the swing lever 36 consists of a circular arc section 42*a* having a radius of curvature coinciding with the radius of the circular locus of the crank pin 40 and permitting the rotation of the crank pin 40 through an angle of approximately 74° in a range about the uppermost position of the crank pin 40, and short straight sections 42*b* extending from the opposite ends of the circular arc section 42*a*, respectively. The cam slot 42 is reinforced along the periphery thereof with a reinforcement 36*a*.

When the take-up lever crank 38 and the crankpin 40 are turned around the arm shaft 28 with the crankpin 40 engaging the cam slot 42 of the swing lever 36, the swing lever 36 is driven for reciprocatory swing motion about the auxiliary shaft 34 between an uppermost position indicated by continuous lines (FIG. 3) and a lowermost position indicated by imaginary lines (FIG. 3) by the crankpin 40, while the needle bar 10 is driven for vertical reciprocatory motion through the needle bar crank 30 and the crankpin 40 by the arm shaft 28 in phase with the arm shaft 28.

Figure 5:
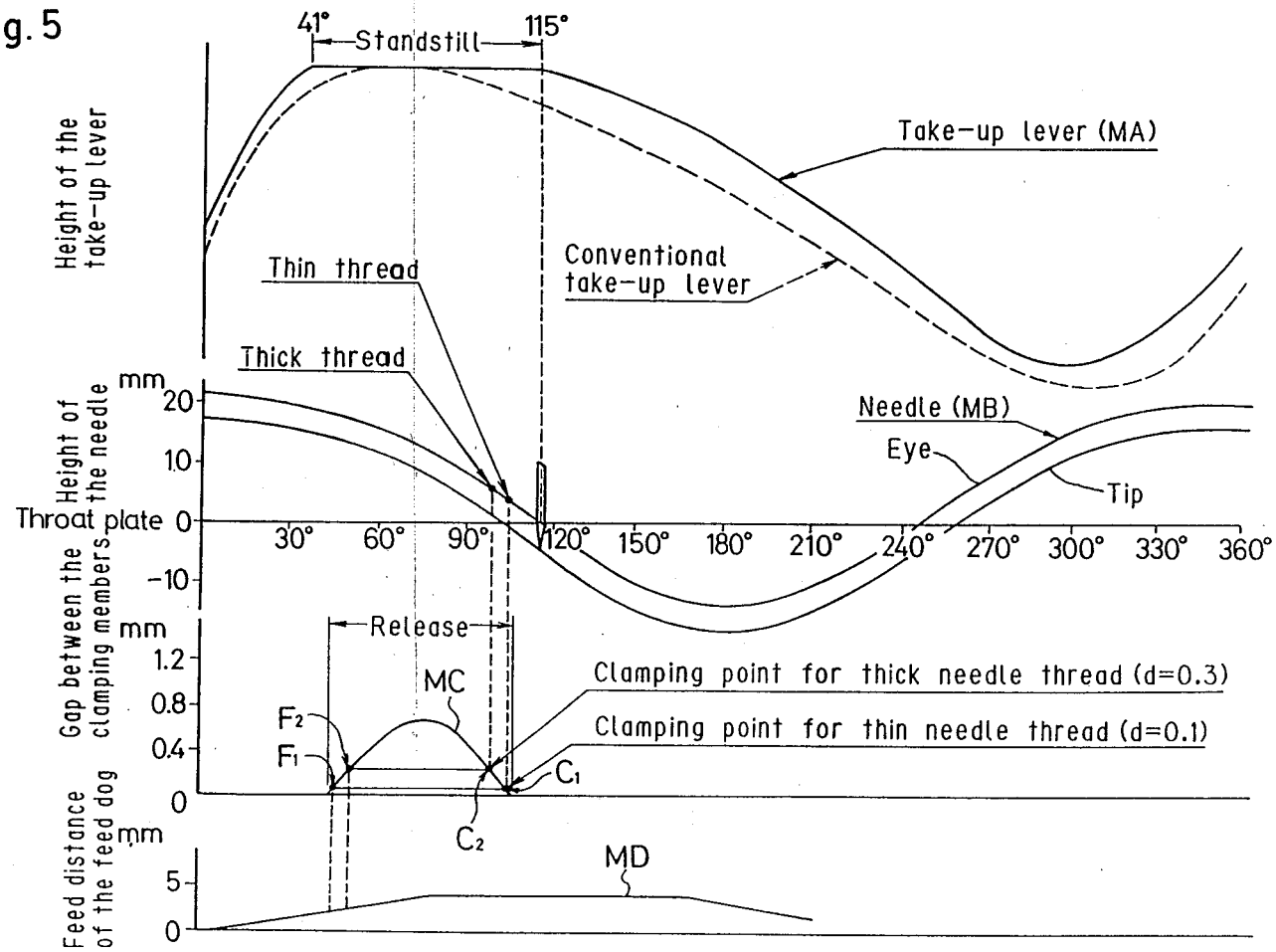
FIG. 5 is a time chart showing the respective motions of the mechanisms of the sewing machine of FIG. 1.
Figure 6:
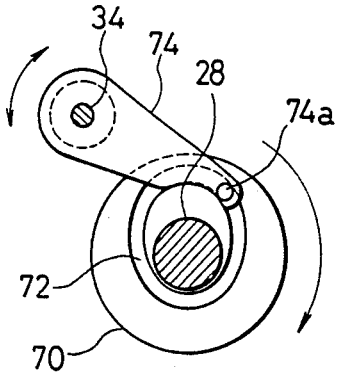
FIG. 6 is a sectional view taken on line VI—VI in FIG. 4.

Since the cam slot 42 of the swing lever 36 has the circular arc section 42*a*, the take-up lever 48, the needle 12 attached to the lower end of the needle bar 10 and the feed dog 23 of the feed mechanism perform motions represented by motion curves MA, MB and MD as functions as the phase angle of the arm shaft 28 as a parameter in FIG. 5, respectively.

The take-up lever 48 is held at the uppermost position from a time after the arm shaft 28 has turned through an angle of approximately 40° from the start of the feed motion to a time when the eye of the needle 12 arrives at the upper surface of the throat plate 22. Accordingly, the take-up lever 48 is held at the uppermost position substantially during the feed motion except, during the initial stage of the feed motion. The swing lever 36 may be designed so that the take-up lever 48 is held at the uppermost position from the start of the feed motion. In either case, the swing lever 36 of the embodiment is comparatively simple in construction and is able to operate smoothly and silently. And, while the take-up lever 48 is held at the uppermost position, a length of the needle thread 14 from the thread supply spool 16 to the throat plate 22 through the thread guide hole 48*a* of the take-up lever 48 is constant.

Figure 9:
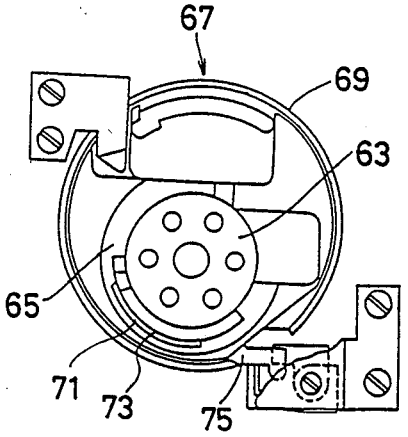
FIG. 9 is a front view of the rotating looptaker.

As shown in FIG. 9, the bed is provided with a rotating looptaker 67 composed of a bobbin case 65 which is restricted not to rotate by a rotation stopping member 75 and contains a bobbin 63 as a bobbin thread holder, and a looptaker 69 for seizing and enlarging a needle thread loop formed at the eye of the needle 12. Supply of the needle thread 14 to the rotating looptaker 67 may be achieved by the take-up lever 48 as a thread take-up member which moves toward the maximum slack position and then toward the maximum thread take up position to tighten the enlarged thread loop. Further, the bobbin case 65 is provided with a plate spring 71 (bobbin thread tension exerting means) for exerting a tension on a bobbin thread 73 drawn out from the bobbin 63.

A thread supply control mechanism will be described hereinafter with reference to FIGS. 2 to 7.

A plate member 50 forming part of the frame is disposed near and on the lefthand side of the needle bar crank 30 disposed on the lefthand side of the arm shaft 28. The plate member 50 extends at right angles to the arm shaft 28. As illustrated in FIGS. 2 and 3, a pre-tension device 52 for exerting a tension on the needle thread 14 is provided, on the left side of the plate member 50 slightly before the arm shaft 28.

Figure 8:
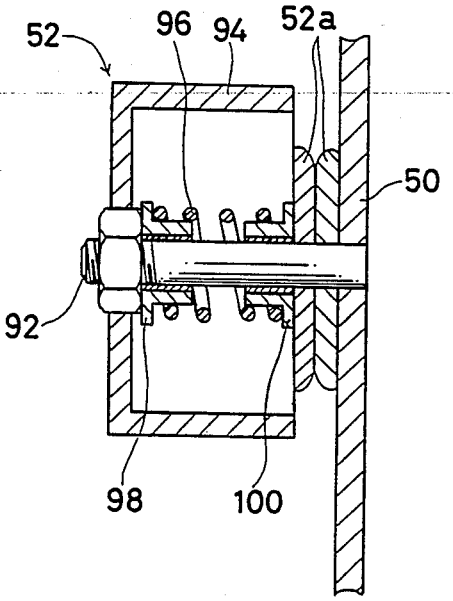
FIG. 8 is a sectional view of the pre-tension device.

This pre-tension device 52, which corresponds to the tension adjusting means, has a shaft 92 attached fixedly to the plate member 50 and extending parallel with the arm shaft 28, as illustrated in FIG. 8, and a pair of tension adjusting discs 52*a*, 52*a* which are attached to the shaft 92 so as to be movable in an axial direction. The shaft 92 has a threaded top end on which a dial 94 is engaged. The dial 94 (operating member) is designed to move axially as it is turned. A coil spring 96 having an elastic constant of 0.62 kg/mm is interposed between the tension adjusting disc 52*a* and the dial 94. The strength of a tension applied to the needle thread 14 by the coil spring 96 with such an elastic constant is substantially equal to or lower than a tension applied to the bobbin thread in an auto tension made to be described later.

A pair of spring receiving members 98, 100 are mounted on the shaft 92 between the tension adjusting disc 52*a* and the dial 94 in such a manner that the spring receiving members 98, 100 are movable in an axial direction, and the coil spring 9 has opposite end portions fitted on the respective cylindrical portions of the spring receiving members 98, 100 with the respective surfaces of the end portions abutting against the flanges of the spring receiving members 98, 100. The spring receiving member 100 remaining in contact with the tension adjusting disc 52*a* prevents stepped portions of the both end surfaces of the coil spring 96 from changing delicately the clamping pressure generated by the pair of the tension adjusting discs 52*a*, 52*a*. The dial 94 can be operated to adjust the force of the coil spring 96 so that the resistance force exerting on the needle thread 14 may be controlled.

An arrow mark is provided on the circumferential surface of the dial 94, a front portion thereof extending through an opening of the front wall of the arm head 8. On the surface of the front wall near the opening, "WEAK ", "AUTO" and "STRONG" are marked on the upper, middle and lower portion respectively. By turning the dial 94, an operator can set the pre-tension device 52 into one of a weak tension mode corresponding to "WEAK", an auto tension mode corresponding to "AUTO" and a strong tension mode corresponding to "STRONG".

In the weak tension mode, the pre-tension is substantially zero. In the auto tension mode the pre-tension is equal to or lower than the tension of bobbin thread. In the strong tension mode, the pre-tension is about 10-15 times of the tension of bobbin thread.

A thread supply control device 54 as thread supply stopping means which clamps or releases the needle thread 14 in synchronism with the rotation of the arm shaft 28 is provided in a thread path portion between a thread supply spool 16 and the thread guide hole 48*a* of the take-up lever 48. The thread supply control device 54 comprises a thread guide plate 56, and a swing lever 58 provided with a thread clamping wheel 64. The thread guide plate 56 is secured to the left side of the plate member 50 at a position below the pre-tension device 52. The swing lever 58 is disposed adjacent to the left side of the thread guide plate 56 and is pivotally attached to the plate member 50 with a hinge screw 62. A link plate 60 also is pivotally attached at the lower end thereof to the plate member 50 with the hinge screw 62. The thread clamping wheel 64 held on the swing lever 58 engages the thread clamping edge 56*a* of the thread guide plate 56 to clamp the needle thread 14 between the thread clamping edge 56*a* and the thread clamping wheel 64. The swing lever 58 is biased resiliently by a spring 66 having one end connected to the frame and the other end connected to the swing lever 58 so that the thread clamping wheel 64 is pressed against the thread clamping edge 56*a*. A contact wheel 68 attached to the upper end of the arm 58*a* of the swing lever 58 is in contact with the front surface of a contact lug 60*a* formed near the lower end of the link plate 60.

Figure 7:
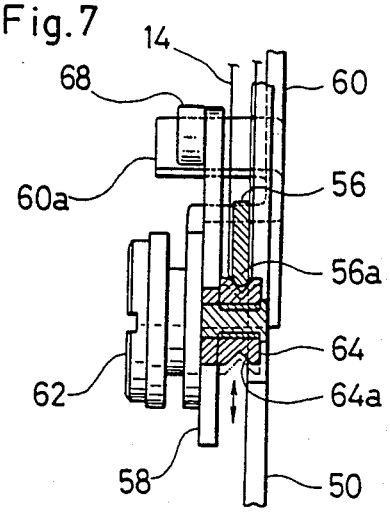
FIG. 7 is a sectional view taken on line VII—VII in FIG. 3.

As illustrated in FIGS. 3 and 7, an annular V-shaped groove 64*a* is formed in the circumference of the thread clamping wheel 64, the V-shaped groove 64*a* of the thread clamping wheel 64 and the thread clamping edge 56*a* of the thread guide plate 56 engage to clamp the needle thread 14 therebetween.

To drive the thread clamping wheel 64 in phase with the rotation of the arm shaft 28 toward and away from the thread clamping edge 56*a* to clamp and release the needle thread 14 alternately at predetermined phase angles of the arm shaft 28, a rotary cam 70 having an elliptic cam groove 72 is fixedly mounted on the arm shaft 28 at a position opposite the right end of the auxiliary shaft 34, and a cam follower 74*a* attached to the free end of a first arm 74 engages the cam groove 72.

On the other hand, a second arm 76 is fixedly mounted to the auxiliary shaft 34 at the left end of the same. A pin 76*a* attached to the free end of the second arm 76 is received in a slot 60*b* formed in the upper end of the link plate 60 to interconnect the second arm 76 and the link plate 60.

In the abovementioned thread supply control device 54, when the arm shaft 28 is rotated to swing the first arm 74 by the elliptic cam groove 72 of the rotary cam 70, the link plate 60 is reciprocated through the auxiliary shaft 34 and the second arm 76 on the hinge screw 62.

When the contact wheel 68 is pushed forward by the contact lug 60*a* of the link plate 60 as the link plate 60 is driven by the second arm 76, the swing lever 58 is turned against the resilient force of the spring 66, so that the thread clamping wheel 64 is separated from the thread clamping edge 56*a* of the thread guide plate 56 to release the needle thread 14. When the contact lug 60*a* of the link plate 60 is moved backward, the swing lever 58 is turned in the opposite direction by the spring 66, so that the thread clamping wheel 64 engages the thread clamping edge 56*a* to clamp the needle thread 14. Thus, the needle thread 14 is clamped and released alternately at predetermined phase angles, respectively. The needle thread clamping and releasing motion is represented by a motion curve MC in FIG. 5.

As is apparent from FIG. 5, during the upward movement of the take-up lever 48 from the lowermost position to the uppermost position for tightening the needle thread 14, the needle thread 14 is clamped by the thread supply control device 54 so that the needle thread 14 is reliably tightened. After the needle thread 14 has completely been tightened, the swing lever 58 is driven in phase with the feed motion to release the needle thread 14 and supply the needle thread 14 of a necessary amount to the take-up lever 48 from the thread supply spool 16. While the needle thread 14 is thus released free, the feed motion and the needle jogging motion are accomplished, and then the needle thread 14 is clamped again before the needle 12 arrives at the throat plate 22. While the needle thread 14 is clamped, the stitching motion is carried out to form a needle thread loop by the shuttle. Accordingly, the needle thread 14 of an amount necessary for feeding the work fabric and for jogging the needle 12 is reliably supplied, while the needle thread 14 is not supplied uselessly while a loop of the needle thread 14 is formed, because the needle thread 14 is clamped during the loop forming period.

When a particular seam formed by needle thread 14 with a fairly strong tension is desirable, the needle thread 14 will be elongated resiliently more than usual by turning a dial 94 of the pre-tension device 52 to give more firm resistance to the needle thread 14. As a consequence, a shorter length of the needle thread 14 will be supplied per stitch so as to obtain the seam formed by the needle thread 14 with a stronger tension. In the contrary, if a seam formed by the needle thread 14 with a lower tension is needed, the thread clamping pressure is lowered by turning the dial 94 of the pretension device 52 to give a lower resistance, and then the needle thread 14 will be elongated resiliently less than usual. As a result, a longer length of the needle thread will be supplied per stitch, and thus the seam can be formed by the needle thread 14 with a lower tension.

Even when the dial 94 is kept inoperative, that is, when the auto tension mode is set the elastic deformation of the coil spring 96 tends to vary in accordance with the thickness of needle thread 14 and the pressure of the coil spring 96 changes according to the thread thickness. Therefore, a suitable tension lower than that of the bobbin thread will be exerted on a fine needle thread and a suitable tension lower than that of the bobbin thread will be exerted on a thick needle thread.

Hence, with such an arrangement of supplying the needle thread 14 in association with the fabric feed motion, there will never occur a supply of more needle thread 14 than required by the aid of the tension exerting on the needle thread 14 even if the latter is released from the constraint of the thread supply control device 54.

As is apparent from the motion curve MC representing the gap between clamping members shown in FIG. 5, owing to the needle thread clamping characteristics determined by the needle thread thickness, and the point at which the thread clamping wheel 64 engages the thread clamping edge 56 to clamp the needle thread as determined by the shape of the elliptic cam groove 72 of the rotary cam 70 which activates movement of the clamping wheel 64, when the thickness of the needle thread 14 is small, the needle thread 14 is released and is clamped at a point $F_1$ and at a point $C_1$, respectively. When the thickness of the needle thread 14 is large, the needle thread 14 is released at a point $F_2$ after point $F_1$, and is clamped at the point $C_2$ before the point $C_1$. Accordingly, thin needle threads and thick needle threads are tightened properly at a low tension and at a high tension, respectively.

A needle thread supply mechanism 78 which draws out the needle thread 14 from the thread supply spool 16 by a predetermined amount and stores the same while the take-up lever 48 is moved downward and the needle thread 14 is clamped between the needle thread clamping wheel 64 and the needle thread guide plate 56 will be described hereinafter with reference to FIGS. 2 to 4.

A sleeve 80 is fitted rotatably on the auxiliary shaft 34 near a position where the auxiliary shaft 34 supports the swing lever 36 at one end, and the end of the swing lever 36 on the auxiliary shaft 34 is fixed to the sleeve 80. An L-shaped arm 82 having a thread catching hook 82*a* at the free end thereof is fixed to the sleeve 80. A thread guide member 84 substantially of a U-shape in front view is disposed on top of the left end of the arm 6 of the sewing machine M. The thread guide member 84 has a top wall 84*a*, a first guide wall 84*b* and a second guide wall 84*c*. The first guide wall 84*b* and the second guide wall 84*c* extend vertically downward from the opposite sides of the top guide wall 84*a*, respectively. The second guide wall 84*c* of the thread guide member 84 is fixed to the upper end of the plate member 50 with a screw 86. The thread guide member 84 is disposed near and above the L-shaped arm 82. The first guide wall 84*b* and the second guide wall 84*c* are disposed opposite to each other with a predetermined distance therebetween. A first guide slit 88*a* and a second guide slit 88*b* are formed laterally opposite to each other in the first guide wall 84*b* and the second guide wall 84*c*, respectively. The respective rear ends of the first guide slit 88*a* and the second guide slit 88*b* are open to receive the needle thread 14 therein. A third guide slit 90 is formed in the upper part of the front end of the second guide wall 84*c*.

The needle thread 14 pulled out from the thread supply spool 16 is extended sequentially through the first guide slit 88*a*, the second guide slit 88*b*, along the left side of the second guide wall 8*c*, via the third guide slit 90, the pre-tension device 52, the thread clamping edge 56*a* of the thread guide plate 56, where the needle thread 14 is returned upward, and then further through the thread guide hole 48*a* of the take-up lever 48, and thread guides 13 and 15 to the eye of the needle 12.

Both the L-shaped arm 82 and the swing lever 36 are fixed to the sleeve 80, and hence the L-shaped arm 82 and the swing lever 36 are driven for swing motion by the take-up lever crank 38 in phase with the rotation of the arm shaft 28. As illustrated in FIG. 3, while the take-up lever 48 is held at the uppermost position as indicated by continuous lines, the L-shaped arm 82 is located, as indicated by dotted lines, behind the needle thread 14 passing the respective front ends of the first guide slit 88*a* and the second guide slit 88*b*. On the other hand, when the take-up lever 48 is moved downward the lowermost position as indicated by imaginary lines, the swing lever 36 swings on the auxiliary shaft 34 and the L-shaped arm 82 swings forward as indicated by imaginary lines on the auxiliary shaft 34, so that the thread catching hook 82*a* is moved forward and engages the needle thread 14 extending between the respective front ends of the first guide slit 88*a* and the second guide slit 88*b*, and thereby the needle thread 14 is pulled by the thread catching hook 82*a* by a predetermined distance. Since the needle thread 14 is clamped between the thread clamping wheel 64 and the thread guide plate 56 while the needle thread 14 is pulled by the thread catching hook 82*a*, a predetermined amount of the needle thread is surely pulled out from the thread supply spool 16.

Thus, while the take-up lever 48 is located at the lowermost position, the needle thread 14 is pulled out from the thread supply spool 16 by the L-shaped arm 82 of the needle thread supply mechanism 78, so that the needle thread 14 between the thread supply spool 16 and the thread clamping edge of the thread guide plate 56 is slackened. After the needle thread 14 has thus been slackened, the take-up lever 48 is moved upward to tighten the needle thread 14, then the needle thread 14 is released from the restraint of the thread supply control device 54 and then the needle thread 14 of a necessary amount is supplied via the thread supply control device 54 and the take-up lever 48 to the needle 12 as the feed dog 23 performs the feed motion and the needle 12 is jogged.

Although the feed motion of the feed dog 23 is started before the needle thread 14 is released, the amount of the needle thread 14 required for such a mode of feed motion is supplemented by the elastic extension of the needle thread 14, and the needle thread 14 is recovered from the elastic elongation as the same is supplied after being released.

As described hereinbefore, the timing of the clamping and releasing of the needle thread 14 can be automatically controlled in response to the thickness of the needle thread 14, and the coil spring 96 has in the pretension device 52 such a small elastic constant of 0.62 kg/mm, and therefore, the resilient pressure of the coil spring 96 varies automatically in accordance with the thickness of the needle thread 14, whereby the needle thread 14 of an amount necessary for feeding the work fabric and for jogging the needle 12 is reliably supplied in sequence so that the thread condition in the stitching, can be adjusted optimally in accordance with the thickness of the needle thread 14.

In this embodiment, both end portions of the coil spring 96 are received respectively by the spring receiving members 98, 100, through which the resilient force of the coil spring 96 is adapted to act on the thread adjusting disc 52*a* and the dial 94. This arrangement may prevent the stepped portions of both surfaces of the coil spring 96 from affecting the thread tension in a subtle manner.

The aforementioned embodiment may be partially modified as follows.

(1) The first guide wall 84*b* may be designed adjustable in lateral position with respect to the second guide wall 84*c* of the thread guide member 84, and the thread supply amount can be adjusted.

(2) The mechanism for driving the swing lever 58 in the thread supply control device 54 may be constituted with an electric actuator which is actuated by a control signal fed from a control device not shown.

The mechanism for clamping the needle thread 14 in the thread supply control device 54 may be replaced with any other type of clamping mechanism.

What is claimed is:

1. A needle thread tension control including separate stopping and adjustable pre-tension exerting devices in combination with a sewing maching having an endwise reciprocatory needle with an eye; a needle thread supply source including a spool supplying needle thread; a bobbin for supplying bobbin thread; a take-up member movable between a maximum thread slack position and a maximum thread take-up position, a feed member for imparting a feed motion to a work fabric in timed relation with the reciprocation of said needle; thread supply stopping means for checking, at least during said maximum thread take-up position of said take-up member, supply of the needle thread supplied from said needle thread supply source in a predetermined timed relationship in synchronism with the feed motion of said feed member; and a needle thread supply path extending from said needle thread supply source via said thread supply stopping means to the eye of said needle;

said adjustable pre-tension exerting device comprising:

tension adjusting means for exerting a tension on the needle thread between said supply source and said thread supply stopping means, said tension adjusting means including means for adjusting said tension to be a predetermined value equal to or lower than a tension of the bobbin thread.

2. A needle thread tension control including separate stopping and adjustable pre-tension devices according to claim 1; wherein said tension adjusting means comprises a shaft member fixed on a machine frame at one end thereof, a pair of tension discs through which said shaft member is extending and at least one of which is movable in a direction of an axis of said shaft member, a dial member screwed adjustably at the other end of said shaft member, and a coil spring for forcing said one of the tension discs toward the other and being arranged around said shaft member between said dial member and said one of the tension discs.

3. A needle thread tension control including separate stopping and adjustable pre-tension exerting devices according to claim 2; wherein said tension adjusting means further comprises a spring seat member slidably attached at said shaft member and provided with a spring seat flange portion between said one of the tension discs and one end of said coil spring.

4. A needle thread tension control including separate stopping and adjustable pre-tension exerting devices according to claim 1; wherein said thread supply stopping means comprises a pair of thread clamping members movable toward and away from each other for checking and permitting the supply of said needle thread and a driving means for driving one of said thread clamping members.

5. A needle thread tension control including separate stopping and adjustable pre-tension exerting devices according to claim 4; wherein said driving means comprises a cam member fixed on an arm shaft, and a cam follower engaged with said cam member and operatively connected to said one of said thread clamping members.

* * * * *